United States Patent [19]

Hart et al.

[11] Patent Number: 4,606,834

[45] Date of Patent: Aug. 19, 1986

[54] LUBRICATING OIL CONTAINING VII POUR DEPRESSANT

[75] Inventors: William P. Hart, Beacon; Donald L. Mays, Hopewell Junction, both of N.Y.

[73] Assignee: Texaco Inc., White Plains, N.Y.

[21] Appl. No.: 774,519

[22] Filed: Sep. 10, 1985

[51] Int. Cl.[4] ..... C10M 107/42; C10M 107/28

[52] U.S. Cl. ..... 252/51.5 A

[58] Field of Search ..... 252/51.5 A; 526/312, 526/336, 282

[56] References Cited

U.S. PATENT DOCUMENTS

| | | | |
|---|---|---|---|
| 4,007,121 | 2/1977 | Holder et al. | 252/51.5 A |
| 4,021,357 | 5/1977 | Morduchowitz et al. | 252/51.5 A |
| 4,036,767 | 7/1977 | Yamamoto et al. | 252/51.5 A |
| 4,036,768 | 7/1977 | Crawford et al. | 252/51.5 A |

*Primary Examiner*—William R. Dixon, Jr.
*Assistant Examiner*—Ellen M. McAvoy
*Attorney, Agent, or Firm*—Robert A. Kulason; James J. O'Loughlin; Carl G. Seutter

[57] ABSTRACT

A multifunctional additive for lube oils contains a terpolymer of lauryl methacrylate, stearyl methacrylate, and N,N-dimethylaminopropyl methacrylamide.

33 Claims, No Drawings

LUBRICATING OIL CONTAINING VII POUR DEPRESSANT

FIELD OF THE INVENTION

This invention relates to lubricating oils. More particularly it relates to multifunctional dispersant viscosity index improvers having pour point depressancy.

BACKGROUND OF THE INVENTION

As is well known to those skilled in the art, lubricating oils for internal combustion engines typically contain a multitude of additives which function as detergents, dispersants, viscosity index improvers, pour depressants, etc. in order to improve the properties of the oil. It is found that it is particularly necessary to improve the properties exhibited by lubricating oil compositions at low temperatures. It is an object of this invention to provide a lubricating oil containing an additive which provides improved properties at low temperatures. Other objects will be apparent to those skilled in the art.

PRIOR ART

The prior art discloses many additives to hydrocarbon lubricating oil compositions which improve the properties including dispersancy and viscosity index. Illustrative of prior art patents is U.S. Pat. No. 4,021,357 which issued May 3, 1977 to Texaco Inc. as assignee of Morduchowitz et al. This patent, the text of which is incorporated herein by reference, discloses as additive to a lubricating oil a tetrapolymer of (i) a first $C_1$–$C_5$ alkyl methacrylate, (ii) a second $C_{10}$–$C_{15}$ methacrylate, (iii) a third $C_{16}$–$C_{20}$ methacrylate and (iv) a N,N-di($C_1$–$C_2$)alkylamino($C_2$–$C_4$)alkyl methacrylamide.

U.S. Pat. No. 3,979,441 issued Sept. 7, 1976 to Lubrizol as assignee of Hoke discloses as dispersant and viscosity modifier for lubricants an oil-soluble polymer of N-3-aminoalkyl acrylamides with polymerizable $C_8$+ esters of unsaturated acids typified by isodecyl acrylate. Note also U.S. Pat. No. 3,586,689 and U.S. Pat. No. 3,883,491 and U.S. Pat. No. 3,666,810 preferred to therein.

STATEMENT OF THE INVENTION

In accordance with certain of its aspects, this invention is directed to a lubricating oil composition comprising (i) a major portion of a hydrocarbon lubricating oil and (ii) a minor, effective, viscosity index improving portion of a terpolymer of (i) a first monomer

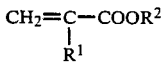

(ii) a second monomer

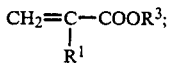

and (iii) a third monomer

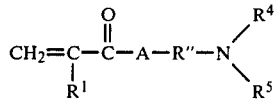

wherein

A is —NH—, —O—, or —S—;

$R^1$ is hydrogen or a lower alkyl group;

$R^2$ is a $C_{10}$–$C_{15}$ alkyl group;

$R^3$ is a $C_{16}$–$C_{20}$ alkyl group;

$R^4$ and $R^5$ are hydrogen or alkyl, alkaryl, aralkyl, cycloalkyl, or aryl groups; and R″ is an alkylene, cycloalkylene, alkarylene, aralkylene, or arylene group.

DESCRIPTION OF THE INVENTION

The terpolymers of this invention may be formed from (i) a first monomer

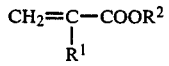

(ii) a second monomer

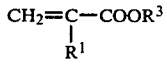

and (iii) a third monomer

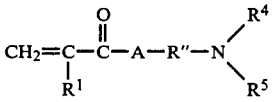

wherein

A is —NH—, —O—, or —S—;

$R^1$ is hydrogen or a lower alkyl group;

$R^2$ is an alkyl group containing 10–15 carbon atoms;

$R^3$ is an alkyl group containing 16–20 carbon atoms;

$R^4$ and $R^5$ are hydrogen or an alkyl, alkaryl, aralkyl, aryl, or cycloalkyl group; and R″ is an alkylene, cycloalkylene, aralkylene, alkarylene, or arylene group.

In the above formulae, $R^1$ may be hydrogen or a lower alkyl group typified by $C_1$–$C_8$ groups including methyl, ethyl, propyl, isopropyl, butyls, amyls, hexyls, heptyls, octyls, etc. In the preferred embodiment, $R^1$ may be hydrogen or methyl, most preferably methyl.

$R^2$ may be an alkyl group containing 10–15 carbon atoms typified by decyl, undecyl, lauryl, tridecyl, myristyl, pentadecyl, etc.

Illustrative of the first monomers which may be employed are the following, the first listed being preferred:

TABLE

| | |
|---|---|
| lauryl | methacrylate |
| lauryl | acrylate |
| lauryl | ethacrylate |
| decyl | methacrylate |
| decyl | acrylate |
| undecyl | methacrylate |
| undecyl | acrylate |
| tridecyl | methacrylate |

TABLE-continued

| | |
|---|---|
| tridecyl | acrylate |
| myristyl | methacrylate |
| myristyl | acrylate |
| myristyl | ethacrylate |
| pentadecyl | acrylate etc. |

In the above formula, $R^3$ may be an alkyl group containing 16–20 carbon atoms typified by cetyl, heptadecyl, stearyl, nonadecyl, and eicosyl.

Illustrative of the second monomers which may be employed are the following, the first listed being preferred:

TABLE

| | |
|---|---|
| stearyl | methacrylate |
| stearyl | acrylate |
| stearyl | ethacrylate |
| cetyl | acrylate |
| cetyl | methacrylate |
| cetyl | ethacrylate |
| heptadecyl | methacrylate |
| nonadecyl | methacrylate |
| eicosyl | acrylate |
| eicosyl | ethacrylate etc. |

The third monomer which may be employed in practice of the process of this invention may be characterized by the formula

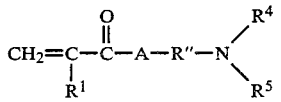

In the above formula $R^4$ or $R^5$ may be hydrogen or a hydrocarbon selected from the group consisting of alkyl, aralkyl, cycloalkyl aryl, and alkaryl, including such radicals when inertly substituted. When $R^4$ or $R^5$ is alkyl, it may typically be methyl, ethyl, n-propyl, isopropyl, n-butyl, i-butyl, sec-butyl, amyl, octyl, decyl, octadecyl, etc. When $R^4$ or $R^5$ is aralkyl, it may typically be benzyl, beta-phenylethyl, etc. When $R^4$ or $R^5$ is cycloalkyl, it may typically be cyclohexyl, cycloheptyl, cyclooctyl, 2-methylcycloheptyl, 3-butylcyclohexyl, 3-methylcyclohexyl, etc. When $R^4$ or $R^5$ is aryl, it may typically be phenyl, naphthyl, etc. When $R^4$ or $R^5$ is alkaryl, it may typically be tolyl, xylyl, etc. When $R^4$ or $R^5$ may be inertly substituted i.e. it may bear a non-reactive substituent such as alkyl, aryl, cycloalkyl, ether, etc. Typically inertly substituted R groups may include 2-ethoxyethyl, carboethoxymethyl, 4-methyl cyclohexyl, etc. The preferred $R^4$ or $R^5$ groups may be lower alkyl, i.e. $C_1$–$C_{10}$ alkyl, groups including eg methyl, ethyl, n-propyl, i-propyl, butyls, amyls, hexyls, octyls, decyls, etc. $R^4$ or $R^5$ may preferably be methyl.

In the above formula, R″ may be a hydrocarbon group selected from the group consisting of alkylene, aralkylene, cycloalkylene, arylene and alkarylene, including such radicals when inertly substituted. When R″ is alkylene, it may typically be methylene, ethylene, n-propylene, iso-propylene, n-butylene, i-butylene, sec-butylene, amylene, octylene, decylene, octadecylene, etc. When R″ is aralkylene, it may typically be benzylene, beta-phenylethylene, etc. When R″ is cycloalkylene, it may typically be cyclohexylene, cycloheptylene, cyclooctylene, 2 methylcycloheptylene, 3-butylcyclohexylene, 3-methylcyclohexylene, etc. When R″ is arylene, it may typically be phenylene, naphthylene, etc. When R″ is alkarylene, it may typically be tolylene, xylylene, etc. R″ may be inertly substituted i.e. it may bear a non-reactive substituent such as alkyl, aryl, cycloalkyl, ether, etc. Typically inertly substituted R″ groups may include 2-ethoxyethylene, carboethoxymethylene, 4-methyl cyclohexylene, etc. The preferred R″ groups may be lower alkylene, i.e. $C_1$–$C_{10}$ alkylene, groups including eg. methylene, ethylene, n-propylene, i-propylene, butylene, amylene, hexylene, octylene, decylene, etc. R″ may preferably be propylene $—CH_2CH_2CH_2—$.

In the above formula, A may be —O—, —S—, or preferably —NH—.

Typical third monomers may be as set forth in the following Table, the first listed being preferred:

TABLE

| | |
|---|---|
| N,N—dimethylamino propyl | methacrylamide |
| N,N—diethylamino propyl | methacrylamide |
| N,N—dimethylaminoethyl | acrylamide |
| N,N—diethylaminoethyl | acrylamide |
| N,N—dimethylaminoethyl | methacrylate |
| N,N—diethylaminoethyl | acrylate |
| N,N—dimethylaminoethyl | thiomethacrylate |

The first and second monomers when prepared commercially may in fact be mixture of esters obtained by use of a crude alcohol mixture during esterification. The carbon number of the monomer is that of the ester which is the predominant ester in the monomer. Commonly, the carbon number may be the weight average carbon number of the alcohol-derived alkyl group making up the esters.

The three-component terpolymers of this invention may be prepared by contacting a mixture consisting essentially of first monomer, second monomer, and third monomer in the presence of polymerization initiator-catalyst and chain transfer agent in an inert atmosphere in the presence of diluent. Typically 58–73 moles, preferably 62–69 moles, say 65.6 moles of first monomer and 21–35 moles, preferably 25–32 moles, say 27.7 moles of second monomer and 6–7 moles, preferably 6.5–6.9 moles, say 6.7 moles of third monomer may be added to the reaction operation.

Polymerization solvent may typically be an inert hydrocarbon, preferably a hydrocarbon lubricating oil (typically 145 P Pale Turbine Oil) which is compatible with or identical to the lubricating oil in which the additive is to be employed present in amount of 5–25 parts, preferably 10–20 parts, say 15 parts per 100 parts of total reactants.

Polymerization initiator-catalyst may be azobisisobutyronitrile, or a peroxide such as benzoyl peroxide, present in amount of 0.05–0.25 parts, preferably 0.1–0.2 parts, say 0.16 parts. Chain terminator may typically be $C_8$–$C_{10}$ mercaptans, typified by lauryl mercaptan, present in amount of 0.10 parts, preferably 0.02–0.08 parts, say 0.06 parts.

Polymerization is carried out with agitation at 25° C.–150° C., preferably 50° C.–100° C., say 83° C. and 0–100 psig, preferably 0–50 psig, say 0 psig for 1–8 hours, say 3 hours. Reaction may be continued until two identical refractive indices are recorded.

The product polymer is characterized by a molecular weight $\overline{M}_n$ of preferably 20,000–120,000, say 80,000. The component weight ratio of first:second:third monomer may be 56–72:24–40:4 say 64:32:4. These corresponds to a mole ratio of 58–73:21–35:6–7, preferably 62–69:25–32:6.5–6.9, say 65.6:27.7:6.7.

The polydispersity index ($\overline{M}w/\overline{M}n$) of these oil-soluble polymers may be 1–5, preferably 1.5–4, say 2.5.

In a typical reaction, the monomers are charged to the reactor together with polymerization solvent followed by chain terminator. Agitation and inert gas (eg nitrogen) flow are initiated. Polymerization initiator is added and the reaction mixture is heated to reaction temperature at which it is maintained until the desired degree of polymerization is attained. Diluent oil (if employed) is added to yield a lube oil concentrate containing about 25–80 w%, preferably 35–70 w%, say 50 w% of the product terpolymer.

The terpolymers prepared may be characterized by the formula:

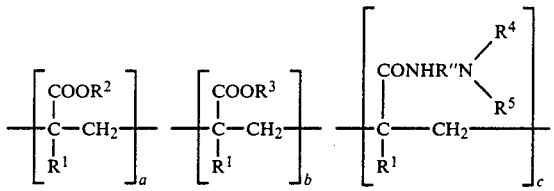

wherein a is 350–640, preferably 370–610, say 399, and b is 100–260, preferably 120–240, say 142.

and c is 60–100, preferably 60–95, say 66.

This corresponds to polymer product containing 58–73 mole%, preferably 62–69 mole %, say 65.6 mole % derived from first monomer, 21–35 mole %, preferably 25–32 mole %, say 27.7 mole % derived from second monomer, and 6–7 mole %, preferably 6.5–6.9 mole % say 6.7 mole % derived from third monomer.

Typical of the terpolymers prepared may be the following, the first listed being preferred:

TABLE

| | |
|---|---|
| A. | lauryl methacrylate<br>stearyl methacrylate<br>N,N—dimethylaminopropylmethacrylamide<br>a is 399; b is 142; c is 66.<br>$\overline{M}_n$ is 81,000. $\overline{M}_w/\overline{M}_n$ is 2.07. |
| B. | lauryl methacrylate<br>stearyl methacrylate<br>N,N—dimethylaminopropylmethacrylamide<br>a is 419; b is 142; c is 69.<br>$\overline{M}_n$ is 62,000. $\overline{M}_w/\overline{M}_n$ is 2.8. |
| C. | lauryl methacrylate<br>stearyl methacrylate<br>N,N—dimethylaminopropylmethacrylamide<br>a is 353; b is 125; c is 59.<br>$\overline{M}_n$ is 64,000. $\overline{M}_w/\overline{M}_n$ is 2.3. |
| D. | lauryl methacrylate<br>stearyl methacrylate<br>N,N—dimethylaminopropylmethacrylamide<br>a is 427; b is 152; c is 70.<br>$\overline{M}_n$ is 68,200. $\overline{M}_w/\overline{M}_n$ is 2.63. |
| E. | lauryl methacrylate<br>stearyl methacrylate<br>N,N—dimethylaminopropylmethacrylamide<br>a is 360; b is 183; c is 68.<br>$\overline{M}_n$ is 69,600. $\overline{M}_w/\overline{M}_n$ is 2.45. |

In practice of this invention, a hydrocarbon lubricating oil composition may comprise a major effective portion of a hydrocarbon lubricating oil and a minor effective portion of the additive polymer. The minor effective portion may typically be 0.01–2.5 parts, preferably 0.05–1 parts, say 0.30 parts, per 100 parts of hydrocarbon lubricating oil. The total composition may also contain other additives typified by oxidation inhibitors, corrosion inhibitors, antifoamants, detergents, dispersants, etc.

Typical of the supplementary detergent-dispersants which may be present may be the ethylene oxide derivative of inorganic-phosphorus-acid-free steamed hydrolyzed polyisobutylene ($\overline{M}_n$ of 700–5000)-$P_2S_5$ reaction product; overbased calcium alkyl aromatic sulfonate having a total base number of about 300; sulfurized normal calcium alkylphenolate; etc. as disclosed U.S. Pat. No. 3,087,956 and U.S. Pat. No. 3,549,534 and U.S. Pat. No. 3,537,966.

Typical of the antioxidants which may be present may be zinc or cadmium dialkyl dithiophosphate or diaryldithiophosphates; alkylated diphenyl amines; sulfurized alkylated diphenylamines; unsulfurized and sulfurized alkylphenols and phenolates; hindered phenols; etc.

Typical of the corrosion inhibitors which may be present may be zinc diaryldithiophosphate; basic calcium, barium, or magnesium sulfonates; calcium, barium, and magnesium phenolates; etc.

It is a feature of this invention that the novel lubricating oil compositions may be characterized by improved pour point when the novel additives are present in amount of 0.005–1 w%, preferably 0.01–0.75 w%, say 0.3 w% of the lubricating oil.

Typically, it may be possible to treat a base lubricating oil of pour point of +25° F. by addition of only 0.3 w% of additive to yield a product having a pour point of minus 40° F. Prior art additives are typically added in much greater quantities (eg 2.30 w%) to achieve such a pour point. Alternatively use of the same quantity of additive as has heretofore been used with prior art pour point depressants (eg 0.3 w%) will yield a pour point of minus 40° F. with the additive system of the instant invention and only of minus 20° F. with typical prior art additives. Pour point is commonly measured by ASTM D-97.

When used as a pour point depressant, it is preferred that the molecular weight $\overline{M}_n$ of the polymer be 20,000–120,000, preferably 50,000–90,000, say 80,000.

It is also a feature of this invention that the novel additives may be used as dispersancy improvers when present in lubricating oil compositions in effective amount of 0.15 w%–1.25 w%, preferably 0.2 w%–0.5 w%, say 0.38 w%. When dispersancy is primarily desired, the molecular weight $\overline{M}_n$ of the polymer may be 20,000–120,000, say 80,000.

The novel additives of this invention may impart viscosity index improvement to lubricating oils when present in amount of 0.25 w%–2.5 w%, preferably 0.6 w%–2 w%, say 1.24 w%. When they are employed primarily as viscosity index improvers, the molecular weight $\overline{M}_n$ may be 20,000–150,000, preferably 40,000–120,000, say 80,000.

Viscosity Index is measured by ASTM D-2270.

It is a feature of the terpolymer additives of this invention (which consist essentially of first, second and third monomer components) that they unexpectedly provide improvements in pour depressancy, dispersancy, and viscosity index, i.e. they may be used, either in whole or in part, to provide all of these functions. When it is desired to utilize the novel additive to provide all three of these functions, it is preferred that the additive be present in amount of 0.15–0.5 w%, say 0.38 w% of the lubricating oil composition. In this instance the molecular weight $\overline{M}_n$ may be 20,000–120,000, preferably 40,000–90,000, say 80,000.

DESCRIPTION OF SPECIFIC EMBODIMENTS

Practice of the process of this invention will be apparent to those skilled in the art from the following wherein, as elsewhere in this specification, all parts are parts by weight unless otherwise stated. An asterisk (*) indicates a control example.

EXAMPLE I

There is added to a stainless steel reaction vessel 199.5 g of N,N-dimethylaminopropylmethacrylamide, 3437.7 g of the Neodol 25L Brand of lauryl ($C_{12}$) methacrylate, 1675.5 g of the Alfol 1620 Brand of stearyl ($C_{18}$) methacrylate, 3.47 g of lauryl mercaptan chain transfer agent and 976.5 g of 145 P Pale Turbine Oil polymerization solvent. The reactor is purged and heated to 83° C. 8.40 g of azobisisobutyronitrile is added. Heating is continued until two identical consecutive refractive indices are recorded (3 hours). There are then added 1.89 g of azobisisobutyronitrile and 4273.5 g of 100 E Pale Oil. The reaction mixture is blended for 1.5 hours; the temperature is raised to 100° C. and maintained there for 1.5 hours. The reaction mixture is then cooled to room temperature.

The product is a 50 w% solution in Pale oil of the polymer containing the following:

| w % | Component |
|---|---|
| 50.3 | Polymer |
| 1.89 | N,N—dimethylamino-propylmethacrylamide |
| 32.55 | Lauryl methacrylate |
| 15.86 | Stearyl methacrylate |
| 9.24 | 145 P Pale Turbine Oil |
| 40.46 | 100 E Pale Oil |

The polymer is found to have a $\overline{M}_n$ of 81,000 and an $\overline{M}_w$ of 168,000 and thus a polydispersity index of about 2.1.

EXAMPLE II*

In this control Example, there is formulated a typical SAE 10W-30 lubricating oil from a high pour stock and containing a prior art polymethacrylate viscosity index improver having the following composition:

TABLE

| COMPONENT | w % |
|---|---|
| High Pour 100 Neutral Oil | 78.20 |
| High Pour 130 Bright Stock | 10.00 |
| Polysobutenyl Succinimide | 2.65 |
| Calcium Sulfonate | 1.84 |
| Zinc Dithiophosphate | 1.18 |
| Dinonyl Diphenylamine | 0.35 |
| Polysiloxane | (50 ppm) |
| Dispersant Polymethacrylate/oil concentrate | 5.78 |
| | 100.00 |

This control formulation has the following properties:

TABLE

| Test | Value | Limits |
|---|---|---|
| Kinematic Viscosity (cST) | | |
| @ 40° C. | 57.7 | — |
| @ 100° C. | 10.66 | 9.3–12.5 |
| Cold Cranking Simulator (cP) @ −20° C. | 3000 | 3500 max |
| Pour Point °F. (ASTM D-97) | −35 | −30 max |
| Pour Stability | | |

TABLE-continued

| Test | | Value | Limits |
|---|---|---|---|
| Ford Max Pour (°F.) | | −35 | −30 max |
| Stable Pour (°C.) Federal Test 791-B Method 203 | | −42 | −30 max |
| Mini Rotary Viscometer (ASTM D-3829) | | | |
| Borderline Pumping Temp °C. max | | −34.0 | −25 |
| Viscosity (Pas) @ | −30° C. | 14.6 | |
| | −25° C. | 6.6 | 30 max |
| | −20° C. | 3.6 | |
| Yield Stress (Pa) @ | −30° C. | 0 | |
| | −25° C. | 0 | 105 max |
| | −20° C. | 0 | |

From the above Table, it may be noted that use of 5.78 w% dispersant polymethacrylate/oil concentrate yields a formulation having a pour point of −35° F. by the Ford Max Pour Test and a borderline pumping temperature of −34° C. by the MRV Test. This example represents the traditional prior art approach to blending motor oils from high pour base stocks to attain acceptable low temperature properties.

EXAMPLE III-IV*

In this series of Examples, there are added to a typical high pour point SAE 10W-30 motor oil various pour point depressants. In Example III, there are added 0.64 parts of the polymer/oil concentrate of Example I. In control Example IV*, there is added 0.52 parts of a prior art low molecular weight ($\overline{M}_n$ of ca 60,000) poly-(alkylmethacrylate).

TABLE

| Component | Example III | Example IV* |
|---|---|---|
| Quaker State 140 Base Stock | 83.58 | 83.90 |
| Additive Package (total) | 7.98 | 7.78 |
| Polyisobutenyl Succinimide | 4.4 | 4.17 |
| Calcium Sulfonate | 1.48 | 1.51 |
| Polyethoxy nonyl phenol | 0.05 | 0.05 |
| Zinc Dithiophosphate | 1.05 | 1.05 |
| 4,4-methylene-bis 2,6-di-t-butyl phenol | 0.25 | 0.25 |
| 4,4-dinonyldiphenyl amine | | |
| Derivatized alkenyl succinic anhydride | 0.50 | 0.50 |
| Silicone anti foamant | (150 ppm) | (150 ppm) |
| Dispersant - Ethylene-propylene Copolymer Oil | 7.8 | 7.8 |
| Copolymer of Example I | 0.64 | |
| Prior Art low molecular wt ($M_n$ ca 60,000) polymethacrylate | | 0.52 |

The values listed for the components of the additive package are weight % of the additive package. (Except for silicone which is parts per million). The values for the polymers of the last two entries are weight % of polymer/oil concentrate. Each of the last two entries was blended so that each formulation contained 0.32 W% of active ingredient. These formulations have the following properties:

TABLE

| Test | Example III | Example IV* | Limits |
|---|---|---|---|
| Kinematic Viscosity (cSt) | | | |
| @ 40° C. | 70.6 | 65.3 | — |
| @ 100° C. | 11.28 | 10.48 | 9.3–12.5 |
| Cold Cranking Simulation | 3500 | 3350 | 3500 max |

TABLE-continued

| Test | | Example III | Example IV* | Limits |
|---|---|---|---|---|
| (cP) C-20° C. | | | | |
| Pour Point °F. (ASTM D-97) | | −40 | −25 | −20 max |
| Pour Stability | | | | |
| Ford Max Pour (°F.) | | −20 | −35 | −20 max |
| Stable Pour (°C.) Federal Test 791-B Method 203 | | −32 | −9 | −30 max |
| Mini Rotary Viscometer (ASTM D-3829) | | | | |
| Borderline Pumping Temp °C. | | 27.5 | −15 | −25 max |
| Viscosity (Pas) | | | | |
| @ | −30° C. | 50.4 | 179.3 | — |
| | −25° C. | 17.8 | 60.1 | 30 max |
| | −20° C. | 7.6 | 25.3 | — |
| Yield Stress | −30° C. | 0 | 210 | |
| | −25° C. | 0 | 140 | 105 max |
| | −20° C. | 0 | 140 | |

From the above Table, the following conclusions may be drawn:

1. The additive of the instant invention (Example III) permits attainment of an ASTM D-97 pour point of −40° F. which is substantially lower than the formulations of control Example IV*.

2. The Method 203 Stable Pour Point of Example III is desirably lower than that of Example IV*. (In fact, the composition of Example IV* did not even fall within the test limits).

3. The borderline pumping temperature in Example III is superior to that of Example IV*. (In fact, the composition of Example IV* did not even fall within the test limits).

4. The product formulation of this invention is satisfactory in all respect. Satisfactory performance is achieved at much lower concentrations than used in Example II.

EXAMPLES V-VI*-VII*-VIII*

In this series of Examples, the low temperature performance of a typical 10W-30 is determined, containing various additives.

In Example V, the composition contained 83.58 w% of High Pour 140 Base Stock. In Examples VI*-VIII*, the composition contained 83.82 w%, 83.99 w%, and 83.94 w% respectively. In Example V, the composition contained 7.98 w% of the same additive package as Example III. The compositions of Examples VI*-VIII* contained 7.78 w% of the same additive package as Example IV. Each composition of Examples V-VIII* contained 7.8 w% of dispersant ethylene-propylene copolymer Examples V contained 0.64 w% of the polymer of Example I of this invention.

Control Example VI* contained 0.60 w% of the terpolymer of ethylene-vinyl acetate-dilauryl fumarate.

Control Example VII* contained 0.43 w% of prior art poly(alkyl methacrylate) of $\overline{M}_n$ of 20,000.

Control Example VIII* contained 0.48 w% of prior art poly(alkyl methacrylate) of $\overline{M}_n$ of 90,000.

These formulations have the following properties:

TABLE

| Test | Example V | Example VI* | Example VII* | Example VIII* | Limits |
|---|---|---|---|---|---|
| Kinematic Visc (cSt) | | | | | |
| @ 40° C. | 70.6 | 64.0 | 65.1 | 66.2 | — |
| @ 100° C. | 11.28 | 10.27 | 10.44 | 10.65 | 9.3-12.5 |
| Cold Cranking Simulator (cP) −20° C. | 3500 | 3150 | 3350 | 2870 | 3500 max |
| Pour Point (°F.) ASTM D-97 | −40 | +25 | −20 | +15 | −20 max |
| Pour Stability | | | | | |
| Ford Max Pour (°F.) | −20 | +20 | −35 | +20 | −20 max |
| Stable Pour °C. Federal Test 791-B Method 203 | −32 | −9 | +16 | −9 | −30 max |
| Mini Rotary Viscometer (ASTM D-3829) | | | | | |
| Borderline Pumping Temp °C. | −27.5 | −15 | −24.5 | −15 | −25 max |
| Viscosity (Pas) @ | | | | | |
| −30° C. | 50.4 | — | 116.2 | Too vis | |
| −25° C. | 17.8 | 908.1 | 34.8 | 2676.3 | 30 max |
| −20° C. | 7.6 | 338.9 | 16.8 | 1774 | |
| Yield Stress (Pa) @ | | | | | |
| −30° C. | 0 | 525 | 210 | 525 | |
| −25° C. | 0 | 490 | 105 | 490 | 105 max |
| −20° C. | 0 | 490 | 70 | 490 | |

From the above Table, the following conclusions may be drawn:

(i) Experimental Example V is characterized by an ASTM pour point of minus 40° F. which is the lowest pour point of those tested.

(ii) Examples VI* and VIII* did not attain a pour point within the limits (−20° F. max) prescribed.

(iii) Example V exhibited better overall pour stability when measured by the Ford Max Pour Test and the Federal Test Method Stable Pour Test.

(iv) Example V exhibited better borderline pumping temperature than did control Examples VI*-VIII*.

(v) The product of this invention satisfactorily passed all the tests at a much lower concentration than that used in Example II.

EXAMPLES IX-X*-XI*

In this series of Examples, further comparative tests are set forth. The formulations tested have the following compositions:

TABLE

| Component | Example IX | Example X | Example XI* |
|---|---|---|---|
| High Pour 100 Neutral | 75.74 | 75.85 | 85.80 |
| High Pour 130 Bright Stock | 10.00 | 8.45 | 8.75 |
| Polyisobutenyl Succinimide | 2.65 | 2.63 | 2.65 |
| Calcium Sulfonate | 1.84 | 1.84 | 1.84 |
| Zinc Dithiophosphate | 1.18 | 1.18 | 1.18 |
| Dinonyl diphenyl amine | 0.35 | 0.35 | 0.35 |
| Silicone | (50 ppm) | (50 ppm) | (50 ppm) |
| Polymer of Example I | 0.64 | | |
| Prior Art Dispersant Ethylene-Propylene Copolymer | 7.60 | 7.75 | |
| Prior Art Dispersant Polymethacrylate | | 1.25 | 4.70 |
| Prior Art Polymethacrylate | | 0.20 | |
| Derivatized Fatty Ester | | 0.50 | 0.50 |

These formulations have the following properties:

TABLE

| Test | | Example IX | Example X* | Example XI* | Limits |
|---|---|---|---|---|---|
| Kinematic Viscosity (cSt) | | | | | |
| @ 40° C. | | 65.1 | 64.4 | 54.6 | — |
| @ 100° C. | | 10.52 | 11.01 | 10.83 | 9.3-12.5 |
| Cold Cranking Simulator (cP) C-20° C. | | 2900 | 2550 | 2280 | 3500 max |
| Pour Point °F. ASTM D-97 | | −30 | +20 | −10 | −20 max |
| Pour Stability | | | | | |
| Ford Max Pour (°F.) | | −20 | +20 | −15 | −20 max |
| Stable Pour °C. Federal Test 791-B Method 203 | | −32 | — | — | −30 max |
| Mini Rotary Viscometer (ASTM D-3829) | | | | | |
| Borderline Pumping Temp °C. | | −29 | −10 | −25 | −25 max |
| Viscosity (Pas) | | | | | |
| @ | −30° C. | 37.5 | Too vis | 113.2 | — |
| | −25° C. | 13.9 | 254 | 27.8 | 30 max |
| | −20° C. | 7.3 | 90.4 | 12.9 | — |
| Yield Stress (Pa) | −30° C. | 0 | 525 | 0 | |
| | −25° C. | 0 | 210 | 0 | 105 max |
| | −20° C. | 0 | 140 | 0 | |

From the above Table, the following conclusions may be drawn:

(i) The formulation of the instant invention passes all the tests.

(ii) The formulations of Control Examples X* and XI* fail the Pour Point and the Ford Max Pour Tests, while the composition of the invention (Example IX) passes.

(iii) The instant invention (Example IX) has better borderline pumping temperature than control Examples X* or XI*.

(iv) The instant invention (Example IX) shows better performance than is obtained in the control (Example XI) wherein the polymethacrylate (q.v. U.S. Pat. No. 4,021,357) is used at a concentration which is greater by a factor of (4.70/0.64) or 7.3.

(v) The instant invention of Example IX has better low temperature performance than is attained in control Example X* wherein the polymethacrylate (q.v. U.S. Pat. No. 4,021,357) is used at higher concentration.

EXAMPLES XII-XV

In this series of Examples, the procedure of Example I is generally followed except that the weight ratio (R) of Neodol 25L lauryl methacrylate to Alfol 1620 stearyl methacrylate in the polymer is varied. The product polymers are tested at 0.32 wt. % concentration of active ingredient in the same base oil as used in Example V. The tests results are as follows:

TABLE

| Example | Ratio (R) | Ford Max Pour °F. | Federal Stable Pour °C. |
|---|---|---|---|
| XII | 58/42 | −35 | −27 |
| XIII | 64/36 | −20 | −31 |
| XIV | 67/33 | −25 | −31 |
| XV | 75/25 | −20 | −24 |

From the above Table, it appears that if the Ford Max Pour Point is the determinative value, the preferred Ratio (R) may be about 58/42. If the Federal Stable Pour Test is the determinative value, the preferred Ratio (R) may be about 65/35. If both tests taken together are the determinant, then the preferred ratio may be 67/33.

EXAMPLE XVI-XIX

In this series of Examples, the procedure of Example I is generally followed except that the molecular weight $\overline{M}_w$ of the product polymer is controlled by use of lauryl mercaptan as chain transfer agent. The weight ratio of reactants is as set forth in Example I. The thickening power (cSt) @ 100° C. of the polymer (2.9 w% in a common base oil) is measured as is the molecular weight $\overline{M}_w$. The results are as follows:

TABLE

| Example | Thickening Power | $\overline{M}_w$ | Ford Max Pour of | Federal Stable Pour of °C. |
|---|---|---|---|---|
| XVI | 6.85 | 176,000 | −17.5 | −31 |
| XVII | 8.30 | 180,000 | −25 | −31 |
| XVIII | 12.67 | 183,000 | −20 | −26 |
| XIX | 17.85 | 240,000 | −20 | −36 |

From this Table, it is apparent that if the Ford Max Pour Point is the determinative criterion, the preferred additive to employ is that of Example XVII having a $\overline{M}_w$ of 180,000. If the Federal Stable Pour Point is the determinative criterion, the additive should preferably have a $\overline{M}_w$ of about 240,000.

EXAMPLE XX

In this series of Examples, it is shown that the novel product of this invention provides dispersant credit when used at 2.95 w% concentration of active ingredient in the following base oil:

TABLE

| Component | W % |
|---|---|
| SNO-130 oil | 75.25 |
| SNO-335 oil | 21.74 |
| Zinc Dithiophosphate (as antiwear agent) | 1.12 |
| Dinonyl diphenylamine (a antioxidant) | 0.39 |
| Magnesium sulfonate (a detergent) | 1.50 |
| Silicone anti-foamant | (150 ppm) |

In experimental Example XX, the product of Example I is present in the base oil, and the formulation is tested in the Bench VC Test. In this test, the ability of an additive to serve as a dispersant is determined by measuring the turbidity of an oil after addition of synthetic blow-by. The oil is rated against three standards, one of which is characterized by excellent dispersancy; and another by good dispersancy and another by poor dispersancy. Rating is on a scale of 0–100. Low ratings at or below that of the oil of good dispersancy are an indication that the oil is a candidate for use as a dispersancy additive. The results are as follows:

TABLE

| Standards | Example XX |
|---|---|
| 10.6/25.4/64.2 | 23.6 |

From this table, it is apparent that the novel product is a high performance dispersant, and it is commparable to presently used dispersant additives.

EXAMPLE XXI

This example demonstrates that the novel product of Example I is a viscosity index improver. When mixed in amount of 5 parts with 95 parts of Solvent Neutral Oil 130, the following are recorded:

TABLE

| Test | Value |
|---|---|
| Kinematic Viscosity (cSt) | |
| @ 40° C. | 128.9 |
| @ 100° C. | 17.40 |
| Thickening Power (cSt) 100° C. | 9.27 |
| Thickening Power (per 1 w % of Polymer in oil concentrate) | 1.85 |

Thickening Power is determined by subtracting the Kinematic Viscosity of the oil from the Kinematic Viscosity of the oil containing the additive.

From the above table, it is apparent that the additive of this invention posseseses thickening power. Other commercial additives such as dispersant polymethacrylate have thickening powers of only about 1.0–1.5 cSt.

Although this invention has been illustrated by reference to specific embodiments, it will be apparent to those skilled in the art that various changes and modifications may be made which clearly fall within the scope of this invention.

What is claimed is:

1. A lubricating oil composition comprising (i) a major portion of a hydrocarbon lubricating oil and (ii) a minor, effective, viscosity index improving amount of a terpolymer of (i) a first monomer

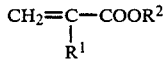

(ii) a second monomer

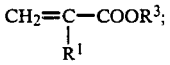

and (iii) a third monomer

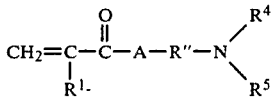

wherein A is —NH—, —O—, or —S—;

$R^1$ is hydrogen or a lower alkyl group;

$R^2$ is a $C_{10}$–$C_{15}$ alkyl group;

$R^3$ is a $C_{16}$–$C_{20}$ alkyl group;

$R^4$ and $R^5$ are hydrogen alkyl, alkaryl, aralkyl, cycloalkyl, or aryl groups; and R″ is an alkylene, cycloalkylene, alkarylene, aralkylene, or arylene group.

2. A lubricating oil composition as claimed in claim 1 wherein in said first monomer, $R^2$ is lauryl.

3. A lubricating oil composition as claimed in claim 1 wherein said first monomer is present in said terpolymer in amount of 58 mole%–73 mole%.

4. A lubricating oil composition as claimed in claim 1 wherein in said second monomer, $R^3$ is stearyl.

5. A lubricating oil composition as claimed in claim 1 wherein said second monomer is present in said terpolymer in amount of 21 mole%–35 mole%.

6. A lubricating oil composition as claimed in claim 1 wherein in said third monomer, R′ is methyl.

7. A lubricating oil composition as claimed in claim 1 wherein said third monomer is present in said terpolymer in amount of 6 mole%–7 mole%.

8. A lubricating oil composition as claimed in claim 1 wherein the molecular weight $\overline{M}_n$ of said terpolymer is 20,000–120,000.

9. A lubricating oil composition as claimed in claim 1 wherein the molecular weight $\overline{M}_n$ of said terpolymer is 40,000–100,000.

10. A lubricating oil composition as claimed in claim 1 wherein said viscosity improving amount is 0.01 w%–2.5 w%.

11. A lubricating oil composition comprising (i) a major portion of a hydrocarbon lubricating oil and (ii) a viscosity index improving amount of 0.01 w%–2.5 w% of a terpolymer, of molecular weight $\overline{M}_n$ of 20,000–120,000, of (a) as first monomer 58–73 mole% derived from lauryl methacrylate;

(b) as second monomer 21–35 mole% derived from stearyl methacrylate; and (c) as third monomer 6–7 mole% derived from N,N-dimethylaminopropyl methacrylamide.

12. The method of improving the properties of a lubricating oil composition which comprises adding thereto a viscosity-index improving amount of a terpolymer of (i) a first monomer

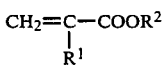

(ii) a second monomer

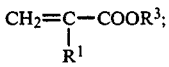

and (iii) a third monomer

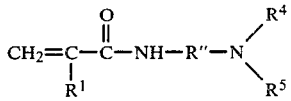

wherein A is —NH—, —O—, or —S—;

$R^1$ is hydrogen or a lower alkyl group;

$R^2$ is a $C_{10}$–$C_{15}$ alkyl group;

$R^3$ is a $C_{16}$–$C_{20}$ alkyl group;

$R^4$ and $R^5$ are hydrogen alkyl, alkaryl, aralkyl, cycloalkyl, or aryl groups; and R′ is an alkylene, cycloalkylene, alkarylene, aralkylene, or arylene group.

13. A terpolymer consisting essentially of (i) a first monomer

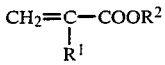

(ii) a second monomer

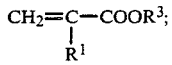

and (iii) a third monomer

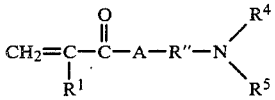

wherein A is —NH—, —O—, or —S—;

$R^1$ is hydrogen or a lower alkyl group;

$R^2$ is a $C_{10}$–$C_{15}$ alkyl group;

$R^3$ is a $C_{16}$–$C_{20}$ alkyl group;

$R^4$ and $R^5$ are hydrogen alkyl, alkaryl, aralkyl, cycloalkyl, or aryl groups; and R′ is an alkylene, cycloalkylene, alkarylene, aralkylene, or arylene group.

14. A terpolymer as claimed in claim 13 wherein in said first monomer, $R^2$ is lauryl.

15. A terpolymer as claimed in claim 13 wherein in said first monomer is present in said terpolymer in amount of 58 mole%–73 mole%.

16. A terpolymer as claimed in claim 13 wherein in said second monomer, $R^3$ is stearyl.

17. A terpolymer as claimed in claim 13 wherein in said second monomer is present in said terpolymer in amount of 21 mole%–35 mole%.

18. A terpolymer as claimed in claim 13 wherein in said third monomer, R′ is methyl.

19. A terpolymer as claimed in claim 13 wherein in said third monomer is present in said terpolymer in amount of 6 mole%–7 mole%.

20. A terpolymer as claimed in claim 13 wherein the molecular weight $\overline{M}_n$ of said terpolymer is 20,000–120,000.

21. A terpolymer as claimed in claim 13 wherein the molecular weight $\overline{M}_n$ of said terpolymer is 40,000–100,000.

22. A terpolymer as claimed in claim 13 wherein the molecular weight $\overline{M}_n$ of said terpolymer is 50,000–90,000.

23. A terpolymer of molecular weight $\overline{M}_n$ of 60,000–80,000, consisting essentially of (a) as first monomer 58–73 mole% derived from lauryl methacrylate;

(b) as second monomer 21–35 mole% derived from stearyl methacrylate; and (c) as third monomer 6–7 mole% derived from N,N-dimethylaminopropyl methacrylamide.

24. The method which comprises copolymerizing a mixture of monomers consisting essentially of (i) a first monomer

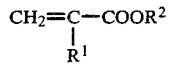

(ii) a second monomer

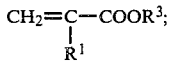

and (iii) a third monomer

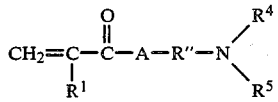

wherein A is —NH—, —O—; or —S—;

$R^1$ is hydrogen or a lower alkyl group;

$R^2$ is a $C_{10}$–$C_{15}$ alkyl group;

$R^3$ is a $C_{16}$–$C_{20}$ alkyl group;

$R^4$ and $R^5$ are hydrogen alkyl, alkaryl, aralkyl, cycloalkyl, or aryl groups; and R′ is an alkylene, cycloalkylene, alkarylene, aralkylene, or arylene group.

25. The method claimed in claim 22 wherein in said first monomer, $R^1$ is lauryl.

26. The method claimed in claim 22 wherein said first monomer is present in said terpolymer in amount of 58 mole%–73 mole%.

27. The method claimed in claim 22 wherein in said second monomer, $R^2$ is stearyl.

28. The method claimed in claim 22 wherein said second monomer is present in said terpolymer in amount of 21 w%–35 mole%.

29. The method claimed in claim 22 wherein in said third monomer R′ is methyl.

30. The method claimed in claim 22 wherein in said third monomer is present in said terpolymer in amount of 6 mole%–7 mole%.

31. The method claimed in claim 22 wherein the molecular weight $\overline{M}_n$ of said terpolymer is 20,000–120,000.

32. The method claimed in claim 22 wherein the molecular weight $\overline{M}_n$ of said terpolymer is 40,000–100,000.

33. The method which comprises copolymerizing a mixture of monomers consisting essentially of (a) as first monomer 58 mole%–73 mole% of lauryl methacrylate;

(b) as second monomer 21 mole%–35 mole% of stearyl methacrylate; and (c) as third monomer 6 mole%–7 mole% of N,N-dimethylaminopropyl methacrylamide.

* * * * *